US006326535B1

(12) United States Patent
Pokallus

(10) Patent No.: US 6,326,535 B1
(45) Date of Patent: Dec. 4, 2001

(54) DRUMSTICK AND METHOD OF MANUFACTURING SAME

(76) Inventor: Kevin Pokallus, 2159 Washington St., Bay St. Louis, MS (US) 39520

( * ) Notice: Subject to any disclaimer, the term of this patent is extended or adjusted under 35 U.S.C. 154(b) by 0 days.

(21) Appl. No.: 09/576,397

(22) Filed: May 22, 2000

Related U.S. Application Data

(60) Provisional application No. 60/135,981, filed on May 26, 1999.

(51) Int. Cl.[7] ..... G10D 13/02
(52) U.S. Cl. ..... 84/422.4; D17/22
(58) Field of Search ..... 84/422.4; D17/22

(56) References Cited

U.S. PATENT DOCUMENTS

| | | | | |
|---|---|---|---|---|
| 3,866,508 | | 2/1975 | Huslig | 84/422 |
| 3,893,364 | | 7/1975 | Harrison | 84/422 |
| 4,114,503 | | 9/1978 | Petillo | 84/422 |
| 4,226,163 | * | 10/1980 | Welcomer | 84/422 S |
| 4,300,438 | | 11/1981 | Handal | 84/422 |
| 4,385,544 | * | 5/1983 | Heiskell | 84/422 S |
| 4,488,470 | * | 12/1984 | Larrain | 84/422 S |
| 4,905,566 | * | 3/1990 | Hughlett et al. | 84/422.4 |
| 5,341,716 | | 8/1994 | Donohoe | 84/422.4 |
| 5,447,088 | | 9/1995 | Mester | 84/422.4 |
| 5,602,355 | | 2/1997 | Lipp | 84/422.4 |

FOREIGN PATENT DOCUMENTS

| | | |
|---|---|---|
| 4001 403 A1 | 7/1990 | (DE) . |
| 416377 | 10/1910 | (FR) . |

OTHER PUBLICATIONS

Aquarian Accessories Catalog.
Zildian Drumsticks pamphlet.
Vater Percussion USA catalog.
Pro.Mark catalog.
Regal Tip A Tradition of Innovation catalog.
The Perfect Pair; Vic Firth catalog.

* cited by examiner

*Primary Examiner*—Robert E. Nappi
*Assistant Examiner*—Kim Lockett
(74) *Attorney, Agent, or Firm*—Garvey, Smith, Nehrbass & Doody, LLC

(57) ABSTRACT

An improved drumstick of the type having a drumstick body having a butt end and a tipped end; an undercoating applied to the wall of at least a portion of the stick body to greatly enhance the foil layer adhering to the drumstick, a hot stamp foil layer applied against the undercoating so at least the tip end and the butt end of the drumstick remaining uncovered by the foil layer, the improved drumstick made from the process of providing the wooden drumstick; coating at least a portion of the wooden drumstick with a dye stain; the dye stained portion of the drumstick is treated with a lacquer undercoat; the dye stained portion of the drumstick is covered with a hot stamp foil, including the tapered portion of the drumsticks; and providing a clear protective topcoat to the entire drumstick. The butt end and tip ends of the drumstick are maintained natural. Further there is provided a compressed portion of the drumstick for providing greater striking strength. Further there is included the step of stamping a logo on the hot stamp foil which covers the drumstick surface.

18 Claims, 5 Drawing Sheets

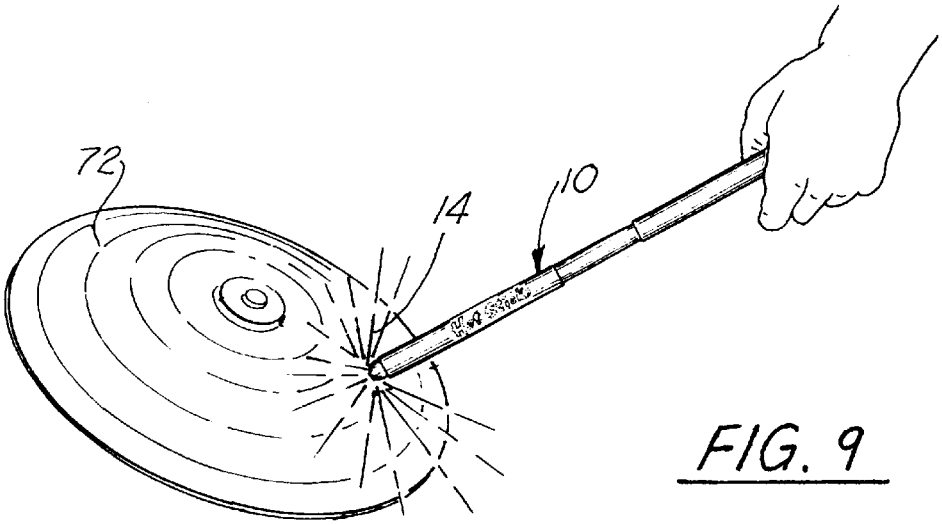
FIG. 9
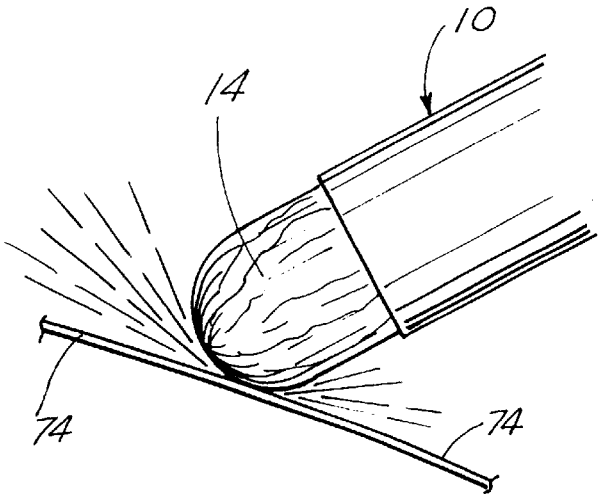
FIG. 10
FIG. 11
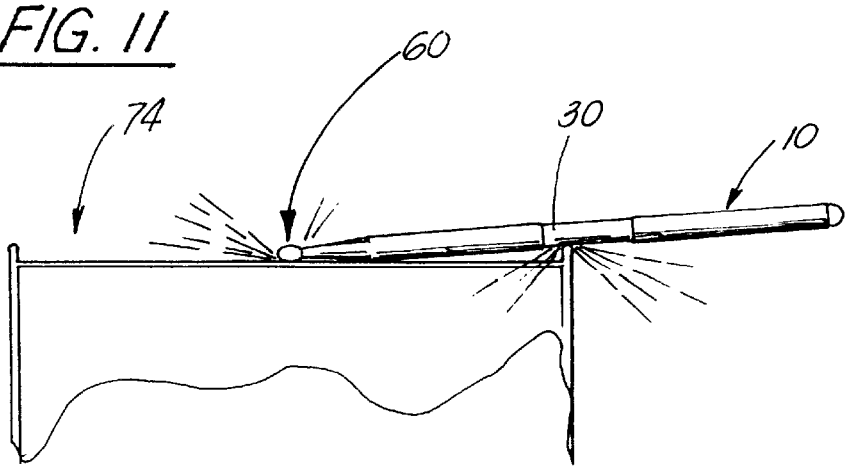

DRUMSTICK AND METHOD OF MANUFACTURING SAME

CROSS-REFERENCE TO RELATED APPLICATIONS

Priority of U.S. Provisional Patent Application Serial No. 60/135,981, filed May 26, 1999 incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to drumsticks. More particularly, the present invention relates to a drumstick having improvements thereto including (a) an exterior finish of a hot stamp foil adhered to the exterior surface of the drumstick along its body and tapered portion, (b) a section of compressed densified substrate material for increasing the durability of the wear sensitive area of the drumstick; and (c) a butt end and tip of the stick which is uncolored for preventing marking drums and cymbals when the sticks are used Further, there is included the process for accomplishing these product features in the improved drumsticks.

2. General Background of the Invention

Traditional wooden drumsticks which have been used for decades to play drums, cymbals and a wide variety of percussion instruments have normally had a clear coating of lacquer, varnish, shellac, acrylic, wax, etc. over bare wood. In 1979, the Hot Sticks Manufacturing Co. introduced painted wooden drumsticks, consisting of hickory drumsticks which were painted with bright enamel finishes and then coated with a polyurethane overcoat for increased durability and improved feel in a drummer's hands. The nylon tip models of these painted drumsticks did not mark drumheads and cymbals when the tip was used as the playing surface, but the shoulder and butt end portions of the sticks could leave marks (paint residue) when they contacted drumheads and cymbals. For the wood tip models of these painted sticks, the tips were left unpainted and then coated with a clear protective topcoat. As was the case with nylon tip models, these sticks left no marks when only the tip was used, but the shoulder and butt end areas left undesirable residues when they came in contact with drums and cymbals.

During the time period from 1983 to present, several competing drumstick manufacturers imitated the Hot Sticks concept of the colored drumstick by introducing products with various color coats (mainly lacquers) over the entire drumstick (including the tip portion of the wood tip models), and they marked drumheads and cymbals to varying degrees, depending upon what color coat was applied. Certain major manufacturers made an issue of the "marking" problem in their advertisements, claiming that the type of finish they used was superior in this respect. In the last two years (1998 and 1999) the world's largest manufacturer of drumsticks (Vic Firth, Inc.) began to leave the tips of their colored wood tip sticks unpainted (thus imitating the Hot Sticks method), and launched a major ad campaign stating the benefits of this feature. It is at this point in the history of the development of the colored wooden drumstick market—where it has been undeniably demonstrated for two decades that colored drumsticks are appealing to a significant number of drummers, but that the "marks" created by the use of such drumsticks are generally considered undesirable—that a totally new approach to manufacturing colored wooden drumsticks utilizing hot stamp foil as a color coat to minimize marking problems seems justified.

Although hot stamp foil has been used as a cosmetic coating on pencils and has been used to print trademarks on drumsticks, a new application of use as a color coating to prevent markings shows unique features on drumsticks which is heretofore not found in the art.

During the research and experimentation stages of the drumstick foil-printing process, the opportunity to develop another major improvement in wooden drumstick design—that of reinforcing a portion of the drumstick which is subjected to extreme impact forces during normal use—was realized. It should be noted that several manufacturers have made, (or attempted to make) reinforced drumsticks throughout the years (U.S. Pat. Nos. 5,341,716; 3,608,419; 3,722.350; 3,859,887; 4,246,826; 4,320,688 and 5,179,237). Typically, a synthetic material is applied over the wood or molded around a portion of the stick, thereby increasing durability due to the synthetic material's strength and resilience as compared to that of wood. Another variation of the reinforced stick is the stick that has been manufactured from "densified" wood, which consists of laminated wood with individual layers compressed and then glued together. With increased density, the wood becomes more durable, but then is much heavier and more cumbersome. The densified wood requires more force and effort to play with than the traditional drumstick and has therefore not found favor with the majority of drummers. As one might imagine, both the synthetically reinforced sticks and the densified wood sticks are more expensive to produce than traditional wooden sticks and therefore come at a higher cost to the consumer. While the goal of these designs—to prolong the usable life of a drumstick—is an appropriate one, both methods alter the response, balance, and feel of the favored traditional drumstick and, at the same time, make it more expensive. For these reasons, consumers have not as yet accepted such designs to a statistically significant degree. The current invention addresses the disadvantages of the various past attempts at reinforcement by simply compressing the surface layers of a section of the drumstick, thereby creating an area of increased density and hardness to improve the stick's impact resistance.

OBJECTS AND BENEFITS OF THE INVENTION

The present invention solves the above-referenced problems in the art in a straightforward manner, by introducing a new product, which is known as the Macrolus drumstick, with novel product features, and the method of manufacturing same.

Therefore, it is a principal object of the present invention to provide the first drumstick to be coated entirely with hot stamp foil (with the exception of the tip and butt-end areas), which has the following benefits:

a) They leave fewer marks or residue on drums and cymbals than traditional painted or lacquered colored drumsticks.

b) The sticks are cosmetically appealing, allowing for special processes and effects which are impossible or cost-prohibitive for traditional colored drumsticks and should therefore have tremendous sales potential.

c) Foil-covered sticks exhibit high visibility in stage and outdoor performances.

d) Foil-covered sticks allow the drumstick manufacturer to produce product more efficiently and economically, and they contribute to the conservation of natural resources (lumber) in that they provide a higher yield of usable drumsticks from a given amount of lumber.

It is a further principal object of the present invention to provide the first drumstick to have an area of densified wood formed by compressing a portion of the stick after it has been machined by customary methods.

The major advantages are the increased durability and improved sound quality which characterize this "reinforced" area. The process is economical and does not change the weight, balance, or feel of the original drumstick. While the current Macrolus drumstick includes a 2¼" wide compressed band in the center portion of the stick to reinforce the critical rim shot area, this concept could be applied to other areas of the stick—i.e. neck, bead, handle, or butt-end (or the entire stick).

It is a further principal object of the present invention to provide the first colored drumstick to have both the tip and butt-end areas uncolored.

Because these areas of the drumstick are the areas most often in contact with drums and cymbals, any undesirable marks which might have occurred during use are further prevented by using only a clear topcoat to protect and seal them.

It is a further object of the present invention to provide a drumstick whose performance is improved by the application of two separate color layers over the majority of the colored portion of the stick.

This is accomplished by dyeing said area of the drumstick with a penetrating dye-stain, and then later printing the area with hot-stamp foil. The advantage of this method is that it produces a longer-lasting finish when the stick impacts drum rims and cymbals during use.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIG. 9 illustrates a view of the butt end of the drumstick making contact with a cymbal;

FIG. 10 illustrates a view of the butt end of the drumstick making contact with a drumhead;

FIG. 11 illustrates the tip of a drumstick making contact with a drum head while the rim shot area of the drumstick simultaneously makes contact with the drum rim;

DETAILED DESCRIPTION OF THE PREFERRED EMBODIMENT

Figures 1, 2, 3, 4, 5, 6:
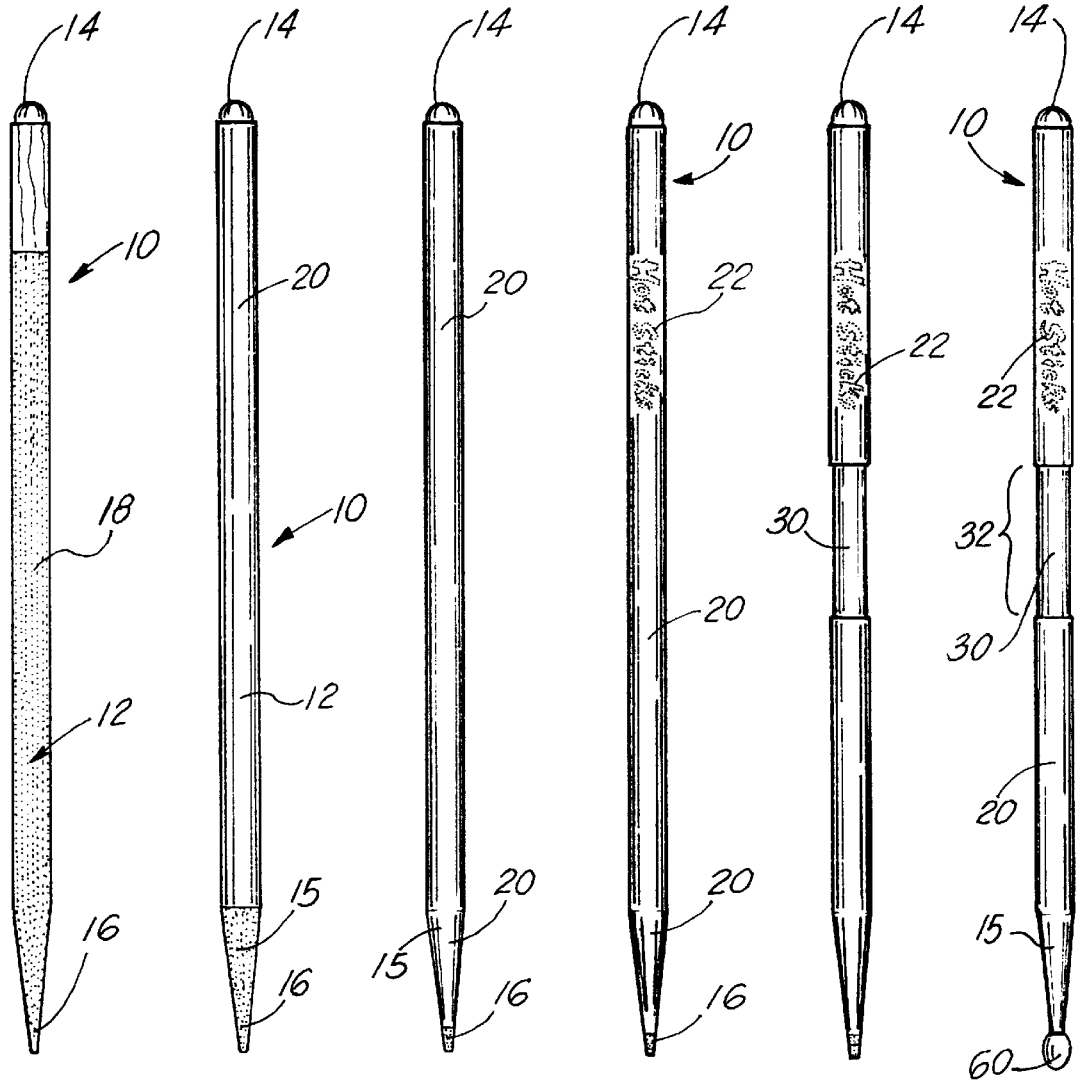
FIGS. 1–6 illustrate the improved drumstick as it is going through both the foil stamping process and the process for reinforcing the "rim shot area" of the drumstick.

FIGS. 1 through 17 illustrate the preferred method of manufacturing the present invention, referred to as the Macrolus process, and the preferred embodiment of the manufactured product. Making reference to the drawings in general, the starting point for the Macrolus process is a drumstick 10, either wood tip or synthetic (i.e. nylon) tip, that has already been machined to dimension by any of a number of existing techniques (including, but not limited to, lathing, grinding (wet or dry), chucking, or molding). The material of the stick 10 could be any appropriate hardwood (i.e. hickory, maple, oak, laminated maple or hickory, etc.) or any number of synthetic materials (plastics, graphite, fiberglass, etc.) which may lend themselves to the coating process.

The typical Macrolus drumstick begins as a hickory or maple wood drumstick machined by a combination of lathing, sanding, and grinding techniques. Nylon-tip models are formed entirely as a finished stick, but do not have the tips applied prior to the finishing process. Wood tip models have the tips formed, but the butt ends are not formed until later in the process.

After the sticks are machined in the manner described, both wood tip and nylon tip models are coated with a clear sanding sealer via a tumbling process. During this process, approximately 400 sticks are placed in an octagonal wooden tumbling chamber approximately 24" in diameter and 24" long. The sticks are placed in the chamber with an appropriate amount of the sealer and are then rotated at approximately 30 RPM until the sealer has soaked into the wood and hardened (normally this takes about 20 minutes).

Once the sealer has been applied to the sticks, they are sanded via an automated machine which uses a combination of 8" diameter foam backed sanding discs and sanding heads with flexible strand of sand paper. The discs are rotated at 1750 RPM in opposite directions as the sticks are pushed between them by an automated feed rod. When a stick makes contact with the pads, it spins and is therefore sanded evenly and symmetrically. The flexible strand sanding heads are used to sand more complicated profiles (i.e. the tips of wood tip drumsticks) while the stick is being rotated by the pads. The purpose of this sanding operation is to eliminate stray burrs and wood fibers which might have been formed during the original machining process, thus producing a stick which is smoother (i.e. easier to dye and coat with foil), and which has a better feel in a drummer's hands during use.

After the sticks have been sanded, they are separated into groups of either wood tip or nylon tip models. The wood tip models are prepared for the dye stain process by dipping the unformed butt ends approximately ¾" into a clear undercoat solution to seal the exposed end grain and thereby limit penetration of the dye-stain coatings This is desirable because the core of the wood is thus left unstained, allowing a clean, attractive butt end to be formed following the dye process.

The sticks—both wood tip and nylon tip models—are next dyed via a dipping process. The current technique utilizes custom-made dipping baskets which hold 143 sticks at a time. The sticks are held in the vertical orientation and are prevented from contacting each other during the dyeing process by two networks of stainless steel mesh. Nylon tip drumsticks are loaded into the dipping fixture with the formed butt ends facing up; wood tip drumsticks arc loaded with the formed tips facing up, the unformed butt ends facing down. The sticks, held in a controlled array by the dipping fixtures, are then dipped into a 15 gallon container of a colored undercoat solution thinned down to a dye stain consistency. Special care is taken not to dip the sticks all the way into the dye (i.e. the butt end of the nylon tip sticks and the tip of the wood tip sticks are left with no dye coating). After the sticks are dipped to the appropriate level, they are removed from the dye and allowed to dry while still in the dipping fixtures.

Once the sticks have thoroughly dried following the dyeing process, the butt ends of the wood tip models are formed via a custom made "chucking" machine. During this process, each stick is gripped horizontally by a precision self-centering air vise which pivots on pillow block bearings between a saw (which cuts the stick to a pre-determined length by trimming the excess from the butt end side) and the chucking position (where a 5000 RPM spindle with an appropriately sized chucking tool advances on the stick on a machine slide, thus forming the desired shape). By machining away the top layers of dyed wood, this process creates a slightly recessed, rounded profile of undyed wood in the butt end area of the wood tip models of drumsticks.

Reference is now made to FIG. 1, where there is illustrated wooden drumstick 10, which has been fully formed, with an elongated body 12, a butt end 14, and a tip end 16. The drumstick 10, in FIG. 1, has been sanded, and dyed with a colored penetrating dye-stain, represented by stipling 18. The nylon-tip models have clear (undyed) butt end 14 (but have not had the nylon tips applied) and the wood tip models have clear (undyed) tips 16 and butt ends 14. The next step in the process consists of a treatment with a lacquer undercoat which facilitates the bonding of the hot stamp foil to the drumstick during the printing process which is to follow. The lacquer coat is applied to the drumsticks via a dipping process as follows: The sticks, both wood tip and/or nylon tip, are loaded into dipping fixtures which consist of 2 pieces of ¼" thick lexan spaced approximately 3" apart with matching arrays of 61 appropriately sized holes. The sticks are held in the fixtures with rubber bands so that no marks or scratches are created during the dipping process. The sticks are actually dipped twice—the first coat covering the top half of the sticks and the second coat covering the remaining portion after the first coat has dried and the sticks have been shifted in the fixtures and the fixtures have been turned upside down. A very consistent, even coating is achieved in each of these two stages by pulling the sticks from the lacquer with a gear driven motor running at a speed which is compatible with the lacquer's viscosity.

Printing the drumstick with hot stamp foil is accomplished in four different stages, each of which requires a different hot stamp machine to print each particular area of the drumstick profile. During the first stage, the handle or body 12 of the drumstick 10 (which could best be geometrically described as cylinders typically ranging from 7/16" to ¾" in diameter and from 10" to 16" in length) are printed using a 1-ton roller hot stamp press with a heated 3" diameter silicone rubber cylindrical stamping die. The hot stamp foil is positioned with a series of feed rollers and tensioning rods such that it is supported between the stick 10 and the stamping die during the printing cycle. The stick 10 is supported in the horizontal orientation between two adjacent aluminum cylinders approximately 1" in diameter. When the print cycle is initiated, the silicone rubber stamping die makes contact with the top of the stick and the supporting cylinders are rotated via a gear motor linkage, thus, in turn, rotating the drumstick and the stamping die. As the stick is rotating, the heat and pressure from the stamping die activate the foil release agent and the foil 20 adheres to the handle portion 12 of the drumstick. 10, as seen in FIG. 2. Different handle diameters are accommodated by varying the speed of the gear motor which drives the supportive aluminum cylinders and by varying the amount of time for which the silicone stamping die is in contact with the drumstick 10. As illustrated in FIG. 2, the drumstick 10 has been coated with a hot stamp foil 20, except for the butt end 14 and the tapered portion 15 and the tip 16.

FIG. 3 illustrates the step in the Marcolus process of printing foil 20 on the tapered portion 15 of the drumstick 10. As the product is illustrated, foil 20 is printed onto the tapered portion 15 of the drumstick 10 with a standard 1-ton vertical hot stamp press which has been customized in the following manner: during the printing cycle, the drumstick is gripped on the extreme tip 16 and butt end 14 by a motor driven indexing fixture. The bottom 180° section of the tapered portion of the drumstick is supported by a contoured "nest" which has been molded to match the taper profile. A heated silicone rubber stamping die which has been molded to fit approximately 100° of the taper profile descends upon the top portion of the supported taper to transfer foil (which is supported between the drumstick and the rubber stamping die via feed rollers and support rods) to the corresponding section of the taper. As the stamping die retracts, the stick is automatically indexed 90° by the indexing fixture, and the cycle is repeated. In total, the stick is automatically printed and indexed four times during a single printing operation, the end result being that the entire tapered section of the stick (with the exception of the tip) is covered with four overlapping sections of hot stamp foil. Having the correct form-fitted tooling—both the supportive "nest" and the silicone stamping die—is crucial to the success of this printing operation. Each model of drumstick requires a separate set of tooling that conforms precisely to the shape of its taper.

FIG. 4 illustrates the next stage in the foil-printing process; that is, the application of the logo, or trademark 22. This is accomplished with a standard 1-ton vertical hot stamping press fitted with an 8" long delrin v-block to support the underside of the stick 10 during the printing cycle. The logo 22 is printed onto the stick 10 with a heated, contoured silicone stamping die which has been engraved with the logo and molded to match the contour of the handle of the drumstick. As before, the foil is held between the drumstick 10 and the silicone stamping die via a series of feed rollers and supporting rods. During the printing operation, the silicone die descends, making contact with the drumstick 10, and the resulting combination of heat and pressure effect the transfer of the logo 22 to the drumstick 10.

Figure 8:
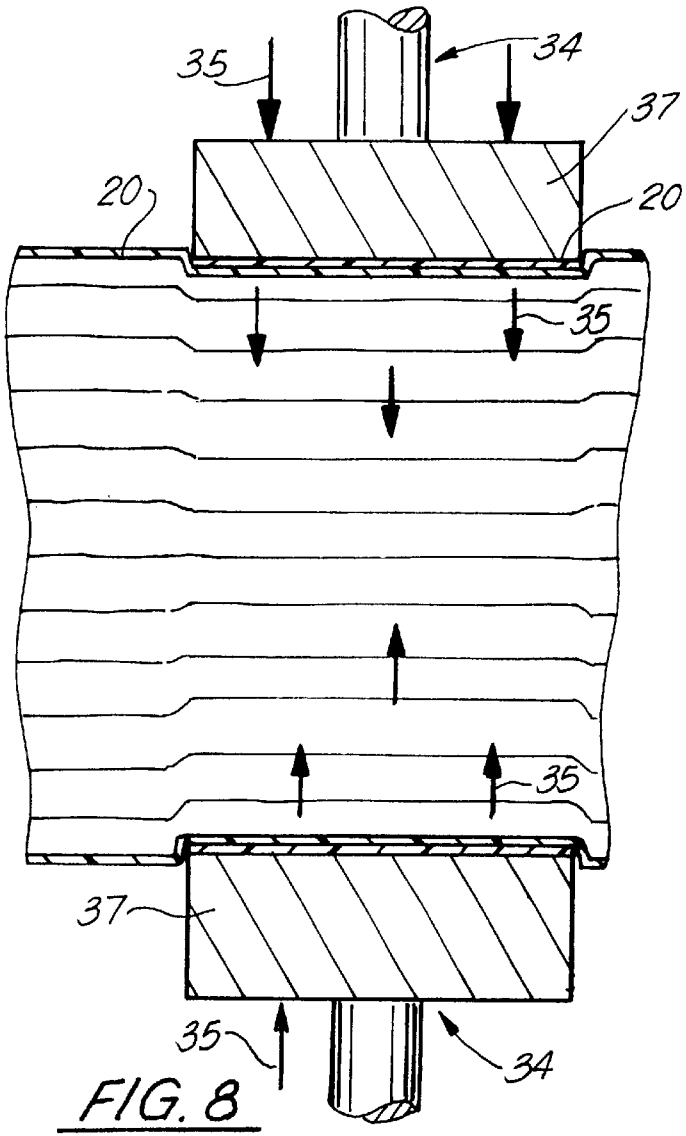
FIG. 8 illustrates the rim shot area of the drumstick during the compression process.
Figure 7:
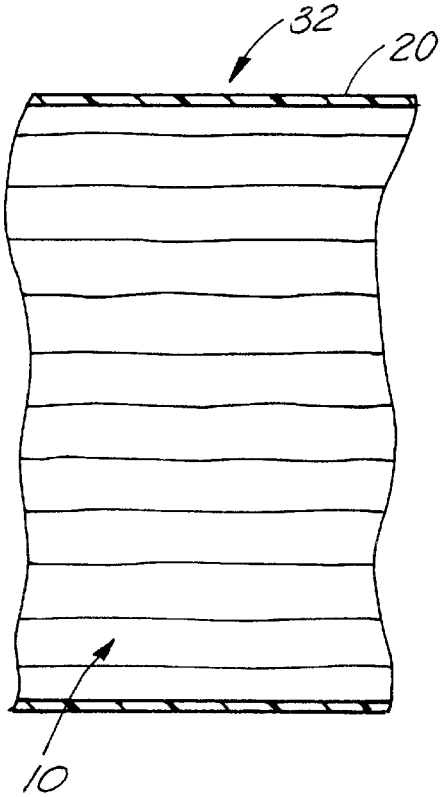
FIG. 7 illustrates a partial cross-section view of the rim shot area of the drumstick prior to compression.

FIGS. 5 through 8 illustrate the compression/printing process which takes place after the foil layer 20, and logo 22, have been applied to the body 12 of stick 10. In concept, FIGS. 5 and 6 illustrate the band of printed, compressed wood 30 in the rim-shot area 32 in the center of the drumstick 10. This band 30 is created in much the same manner as the taper print process. FIG. 7 illustrates the area 32 before the compression of the area 32 has occurred. Turning now to FIG. 8, a 5-ton hot stamping press 34 was required to compress (and therefore densify) the band 30 of wood ( in the direction of arrows 35) ranging anywhere between 2" to 5" wide to the desired depth of 0.015" to 0.020" when the drumsticks were manufactured from the traditionally accepted hardwoods such as hickory. It was also shown that hardened steel stamping dies 37, machined to match the desired band contours, were required to withstand the extreme stamping pressures which characterize this process. When the band 30 on the stick is printed/compressed, as seen in FIG. 8, the bottom of the center portion of the stick is supported by a steel form-fitted nest which matches the profile of the heated steel stamping die 36 which descends from above. The stick is held in an indexing fixture during the printing operation, which consists of printing/compressing 75° sections of the stick's circumference, and then automatically indexing/printing the stick five times to completely form the band 30 around the stick 10, as seen in FIGS. 5 and 6. The end result of this process is a compressed and printed band 30 in approximately the middle of the stick which adds both functional (by densifying and therefore reinforcing the rim shot area) and cosmetic advantages. (i.e. The printed band 30 makes the sticks more appealing in that the band color could be selected to separate/complement, or add contrast to different color combinations of foils which may be printed on the sticks.) While a band 30 of 2¼" width currently seems to represent the best compromise between the functional and cosmetic aspects of this new drumstick feature, it may be necessary to change this dimension on the basis of the sales and field test data which will be generated when the sticks are marketed.

Figure 12:
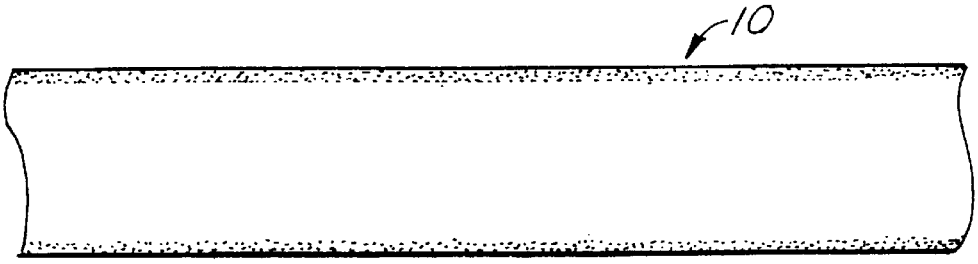
FIGS. 12, 13 and 14 illustrate a bare drumstick surface that has not been treated with hot stamp foil being compressed in the rim shot area.
Figure 13:
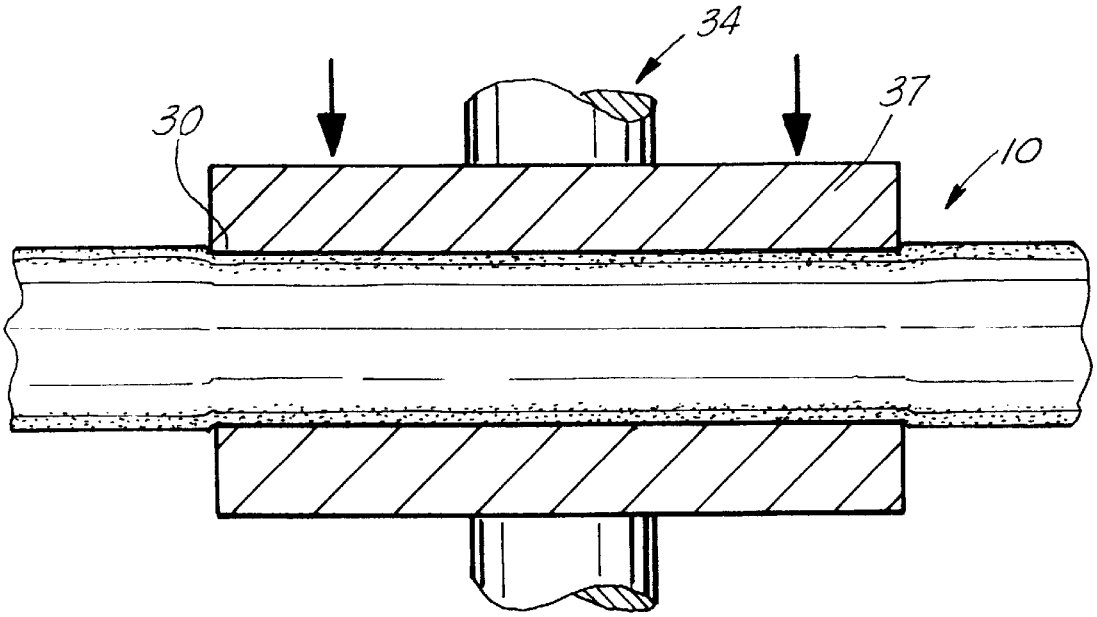
Figure 14:
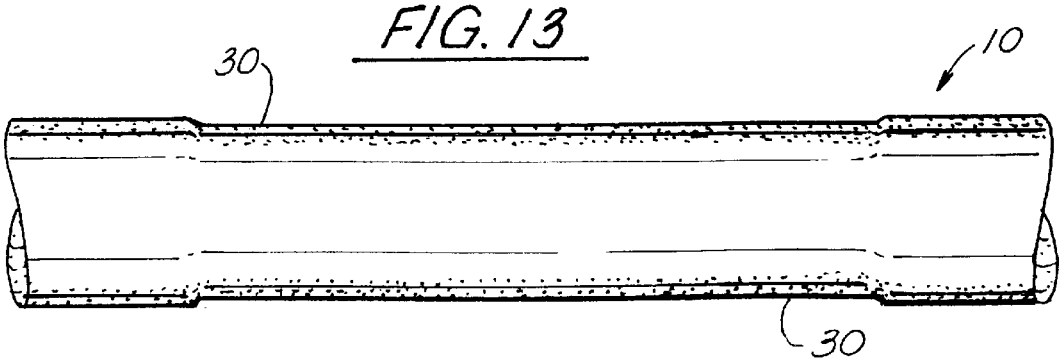

Unlike FIGS. 5 and 6, which illustrate the band 30 on drumstick 10 being compressed after the foil layer 20 has been applied, FIGS. 12 through 14 illustrate the case where it may be desirable to compress and densify a portion 30 of the drumstick 10 without applying a layer of foil 20 to the stick, thereby reinforcing the stick 10 without printing on it.

Upon the completion of the printing process described above, FIG. 6 illustrates nylon tips 60 having been applied to the nylon tip models of the drumsticks 10 by automatically dispensing a precise amount of epoxy glue into the tip 60 and then pushing the tip onto the stick with a pneumatic press.

Both the wood tip and nylon tip models of the drumsticks receive a clear protective overcoat as the final step in the manufacturing process. While this overcoat prolongs the useful life of the foil by increasing durability, it also contributes to the cosmetic appearance by enhancing the depth and gloss characteristics of the foil. Ideally, this overcoat should be crystal clear and non-yellowing so as not to diminish the brightness and reflectivity of the hot stamp foils. The overcoat must be compatible with the foils in that it should not dissolve the dyes and/or inks that color the foils, and it should not in any way degrade the bond of the foil to the drumstick. Furthermore, the overcoat must have a texture and slip characteristic which drummers find acceptable when the sticks are used (i.e. if the sticks are too slippery, the drummer will have trouble holding onto them; if the sticks are too tacky, they will cause blisters). There is any number of finishes which fit the list of desired characteristics to varying degrees. Methods of application include, but are not limited to, tumbling, dipping, and spraying and are dictated by the actual finish being applied. Examples that have shown the most promise include water based acrylics, urethanes, polyurethanes, and lacquers, and certain families of waxes, epoxies, and mineral spirits based acrylics. Research has included experimentation with additives which enhance the grip and slip characteristics—ranging from liquids such as waxes and silicones to ground powders such as silica and glass—of the finish.

FIGS. 9 through 11 illustrate the use of the new drumstick 10 in striking the butt end 14 of the stick 10 against drums 70 and cymbals 72 such that the stick 10 does not mark the surface at the point of contact. FIG. 9 is an isolated view of the butt end 14 in contact with a cymbal 72, while FIG. 10 is an isolated view of the butt end 14 in contact with a drum head 74. Furthers FIG. 11 illustrates the reinforced portion 30 of the stick 10 striking the rim 76 of the drum 70 as the tip 60 strikes the drum head 74. This reinforced portion increases the useful life of the stick when it is used in the manner indicated.

FIGS. 12 through 14 illustrate a bare wooden drumstick 10 having no hot stamp foil treatment, but is being prepared for forming the compressed reinforced portion 30. In FIG. 12 there is illustrated a portion of drumstick 10, untreated. In FIG. 13, the press 34, having hardened steel stamping dies 37 is compressing the portion of drumstick 10, to form a reinforced band 30, as seen in FIG. 14, in the manner as was discussed earlier in relation to FIG. 8. Thus, the plain, wooden drumstick 10 is now includes the reinforced band 30, which is a stronger, densified portion of the stick.

Figure 15:
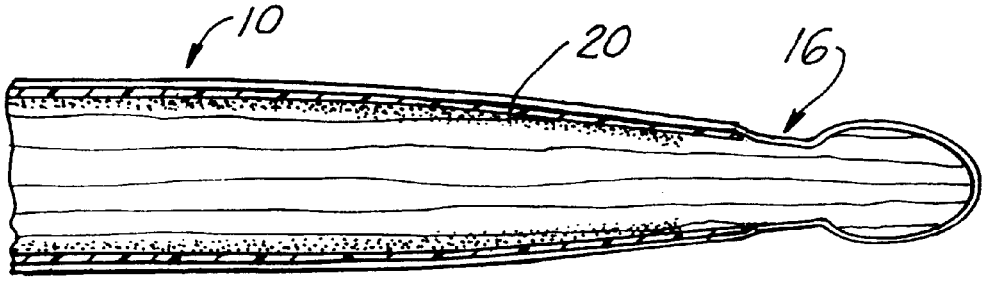
FIG. 15 illustrates a partial view of the drumstick covered with hot stamp foil, yet with the drumstick tip being bare.
Figure 16:
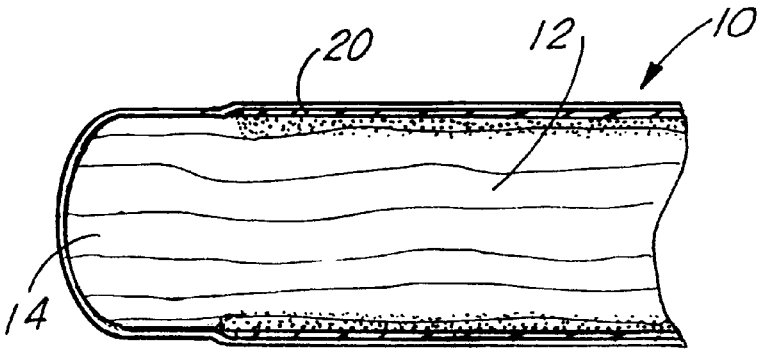
FIG. 16 illustrates the butt end of a foil covered drumstick being bare.
Figure 17:
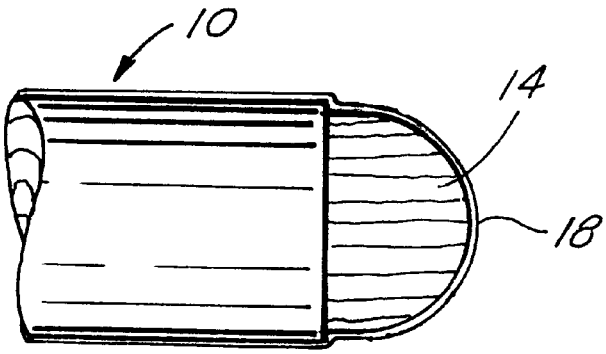
FIG. 17 illustrates the butt end of a drumstick being covered with a clear lacquer type material.

FIG. 15 illustrates the tip end 16 of drumstick 10 having the foil layer 20 terminating at the tip 16 of tapered portion 15, where the tip 16 is not covered with the foil layer 20, but is left bare. Likewise, FIG. 16 illustrates the body 12 of drumstick 10 covered with the foil layer 20, but the butt end 14 being left bare wood. In FIG. 17, the butt end 14 of the drumstick is not left bare, but is covered by a layer of clear coat of lacquer 18. Therefore, when the stick is covered with the foil layer 20, the butt end 14 and tip 16 are left bare, or may be covered with lacquer 18 so that the drum or cymbal is not marked by the stick.

The new Macrolus drumstick, produced through the Macrolus process, is shown to be superior to all known existing colored drumsticks in the following respects:

1) The color coating on the Macrolus drumstick has two different color layers. The first layer is a dye-stain which penetrates deep into the wood fibers for a long-lasting effect. The second color coating is a coating of hot stamp foil which minimizes drum and cymbal marks because the foil actually consists of a deposit of dyed or printed aluminum particles as thin as 0.0002" thick in most instances, as opposed to a painted or lacquered finish which can be as thick as 0.004". While it is logically obvious that a thinner coating should leave fewer marks, it should also be noted that the aluminum particles which constitute the foil layer show very little inclination to stick to drums and cymbals under normal playing conditions. Because of these differences, the foil coated drumsticks exhibit negligible marking tendencies when compared to painted/lacquered finishes.

2) By using hot stamp foil as the top color coat on a drumstick, a wide range of colors and effects which have never before been possible are now easily available. Hot stamp foils have a far greater visual impact than conventional paints and lacquers (notice the wide use of hot stamp foils in the advertising and packaging industries), and it has been well-documented that certain types of foils (i.e. holographics and special effects) enhance the marketability of a product as much as 300–400% when they are introduced.

For drumsticks in particular, the "flashy" quality of hot stamp foils is an obvious advantage in stage settings with intense lighting, or for marching bands in outdoor settings under direct sunlight.

An equally important advantage of a foil covered drumstick is that the foil printing process allows for printing different areas of the stick with different colors in a very precise, professional and repeatable way. To attempt to imitate this type of "zoned" effect with paints or lacquers would be very difficult and expensive.

3) The Macrolus drumstick conforms to top industry standards in that the tips of wood-tip models are coated with only a clear top coat so as to prevent marking drums and cymbals when a drummer plays using the tips of the sticks. In addition, however, the butt ends of the Macrolus drumstick—both for wood and nylon-tip models—are coated with only a clear top coat to prevent marking on the occasions where a drummer plays cymbals or drums with the butt end of the stick. The Macrolus drumstick is the first colored drumstick to feature an uncolored butt end for nylon-tip models and both an uncolored butt end and tip on wood-tip models.

4) By popularizing colored wooden drumsticks, the wood material selection process is made more efficient during the manufacturing process. As an example, the most popular wood for manufacturing drumsticks in today's industry is by far "white" hickory. In many instances, hickory of other colors (i.e. dark wood or "two-tone", which is a mixture of light and dark colors) could make a drumstick equivalent in quality and performance to that of white hickory, but major manufacturers have popularized the cosmetic appearance of the pure white hickory. Consequently, there are many instances in which a drumstick with a minor color variation or stain—every bit as good in every other respect when compared to white hickory—is rejected during the manufacturing process because of this minor flaw. If the sticks of this description were coated with foil and therefore made more attractive and marketable, there would be a much higher percentage of usable wood from a given amount of hickory, thus contributing to cost savings, manufacturing efficiency, and raw materials conservation.

In addition to the benefits associated with its coating of hot stamp foil, the new Macrolus drumstick addresses the issue of reinforcing the traditional wooden drumstick in the crucial "rim shot" area without introducing the disadvantages inherent in the other past approaches. The Macrolus reinforcement technique is accomplished by compressing the outer layers of the rim shot area of a pre-machined traditional wooden drumstick. By using a 5-ton vertical press fitted with contoured stamping dies and an indexing unit, each stick has a compressed "band" formed around its circumference approximately 0.015" to 0.020" deep. The resultant top layers of densified wood are more capable of withstanding the impact of the stick with the metal drum rim when a drummer performs a rim shot. (A "rim shot" is performed when a drummer strikes the head and the rim of a drum simultaneously by controlling the angle of the stroke such that the tip (or butt end) of the stick strikes the drum at the same time that the center portion of the drumstick strikes the drum rim—see FIG. 11.)

By reinforcing the rim shot area (At present, this area is a 2¼" wide band located in the approximate center of the stick. These specifications are likely to change on the basis of market research and sales statistics after the sticks are sold throughout the music industry.) in the manner as described, the weight, balance, feel and response of the stick are not affected in any way. The handle of the stick is left at its full diameter for a comfortable grip, and the weight distribution from the tip to the butt-end of the stick has not been altered. As a matter of fact, the only apparent change is the increased density of the outer layers of wood in the crucial "rim shot" area, a change which produces a more durable stick and a "brighter", more consistent, rim shot sound—both desirable characteristics. One might argue that the improvement in the durability of the rim shot area of the drumstick is not as drastic or long-lived as that which is typically associated with the previously attempted methods of drumstick reinforcement, but the Macrolus process is extremely cost effective—something which can be marketed to drummers with negligible added cost.

The Macrolus process for manufacturing foil covered drumsticks combines several new, unique drumstick features. Each individual characteristic that is unique to the Macrolus drumstick could be further developed or effected by means of different manufacturing processes to produce a somewhat similar result. Each individual feature of the Macrolus drumstick—as well as the sum total—should be protected within the scope of a patent in that each of the features is totally original and each has merit and advantages to justify it when subjected to individual analysis.

I DISCUSSION OF HOT STAMP FOIL COATING VARIATIONS:

There are several variations of hot stamp foil coatings and processes which will be covered by this patent. The current invention provides for a single layer of hot stamp foil covering the entire surface (excluding the tip and butt end areas) of a wooden drumstick applied over a coating of lacquer, which has been applied over a colored dye-stain coating, which has been applied over a sanded layer of clear undercoat/sealer. The entire drumstick is further protected by a clear, protective overcoat. Variations of this process include, but are not limited to:

a) Any drumstick manufactured of any suitable hardwood or any synthetic material which is appropriate for use as a drumstick material (or any combination thereof) and which lends itself to the foil process wherein a significant portion of its surface is covered by hot stamp foil (or heat transfer) including the case where the entire drumstick surface (including tips and butt ends) is covered with hot stamp foil (or heat transfer).

b) Any drumstick as in part a with one or more coats of hot stamp foil applied in any sequence or combination.

c) Any drumstick as in parts a and b with any combination of different types of sanding sealer, dye-stain, undercoats, or overcoats including multiple coats of any or all such coatings as well as the elimination of any or all such coatings. This variation would include cases where totally different color undercoats (i.e. colored or dyed paints, lacquers, varnishes, vinyls, etc.) or impregnated sealer coatings—colored or clear—were employed.

d) Any drumstick as in parts a, b and c with variations in the sanding process (i.e. sanding with different processes or with different grits of sandpaper, sanding more than once, or no sanding at all).

e) Any drumstick as in parts a, b, c and d which is coated with hot stamp foil using a process other than that which is described in the manufacturing process description (i.e. vertical press to apply foil over the entire print area with contoured dies, roller presses that apply foil over the entire print area with soft or contoured rubber rollers, vacuum forming, etc.).

f) Any drumstick as in parts a, b, c, d and e wherein processes different than those described are used in the application of the overcoat and undercoat layers of the finish.

g) Any drumstick as in parts a, b, c, d, e and f regardless of the color or texture of the hot stamp foil or heat transfer. This includes cases where different color zones are applied to the sticks and where textured hot stamp foils (or heat transfers) even clear—are applied to change the grip or sound characteristics of the drumstick.

h) Any drumstick as in parts a, b, c, d, e, f, and g wherein the logo or trademark—or any subsection of the drumstick—is printed or coated with inks, dyes, or paints.

i) Any drumstick as in parts a, b, c, d, e, f, g, and h with or without any section or portion of the drumstick (including the entire stick) compressed for reinforcement. This includes any sticks which have been partially or totally reinforced with synthetic materials.

II DISCUSSIONS OF COMPRESSED, DENSIFIED BAND VARIATIONS:

a) The process could be applied to any drumstick manufactured of any suitable hardwood or synthetic material (or any combination thereof)—either colored or uncolored (uncolored would include cases of clear coatings or no coatings) in part or in total—which lends itself to the compression process.

b) Any drumstick as described in part a with a compress ed band of any width on the handle section, including the case where the major portion or entire length of the handle is compressed.

c) Any drumstick as described in part a with an area or any combination of areas of the drumstick compress for densification. This includes the cases of the handle, tip, butt end and tapered portions of the stick as subsections as well as the case of the entire drumstick.

d) Any drumstick as described in parts a, b and c wherein a technique other than that described is used to compress the drumstick or subsection thereof (i.e. rather than a vertical press with an indexer, the stick could be compressed between contoured rollers.).

e) Any drumstick as described in parts a, b, c, and d regardless of the degree or depth of compression.

f) Any drumstick as described in parts a, b, c, d and e wherein the portion of the stick which is to be compressed is left oversize during the machining process and then later compressed to the desired dimension via any number of compression techniques.

g) Any drumstick as described in parts a, b, c, d and e wherein the portion of the stick which is to be compressed is left oversize during the machining process, then compressed to a smaller, but still oversize dimension and then remachined or sanded to the final dimension.

h) Any drumstick as described in parts a, b, c, d, e, f, or g, wherein a texture is created in the compressed areas as a result of the compression process. This does not cover the case where a texture has been created on the outer surface of the wood with no significant compression, or densification of the outer layers of drumstick material.

III DISCUSSION OF UNCOLORED TIP AND BUTT END VARIATIONS:

a) The scope of the invention covers any drumstick manufactured of any suitable hardwood or synthetic material (or any combination thereof) which has been subjected to a coloring or decorating process wherein the butt ends of the sticks are left uncolored, whether the tip is synthetic or wooden and whether or not the tip is colored or decorated. For the purpose of this claim, the "butt end" of the stick is considered to be the portion of the stick at the end opposite the "tip" portion of the drumstick (see FIG. 17). The tip portion may be shaped in any configuration which renders it useful in any number of drumming and percussion applications, including the case where the tip is shaped with the bluntly rounded profile more commonly used on butt ends.

b) Any drumstick as described in part a which has been colored or decorated regardless of the process used to apply the color/decorative coating and the nature of the coating itself (i.e. colored paints, lacquers, varnishes, vinyls, dyes, inks, hot stamp foils, heat transfers, etc.)

The foregoing embodiments are presented by way of example only; the scope of the present invention is to be limited only by the following claims.

What is claimed is:

1. An improved drumstick, comprising:

a. a drumstick body having a first striking end and a second handle end;

b. a hot stamp foil layer applied to at least a portion of the striking end of the drumstick body, the hot stamp foil layer minimizing blemishing of a percussion instrument when the striking end of the drumstick strikes the percussion instrument.

2. The drumstick in claim 1, wherein the hot stamp foil layer is applied to at least 10% of the drumstick body.

3. The drumstick in claim 1, further comprising an undercoating to the drumstick on at least the portion covered by the hot stamp foil layer.

4. The drumstick in claim 1, wherein at least tips of the first and second ends of the drumstick are not coated with the hot stamp foil layer.

5. The drumstick in claim 1, further comprising a compressed portion of the stick body defining an area of increased strength of the drumstick against impact.

6. An improved drumstick, comprising:

a. a drumstick body having a first striking end and a second handle end;

b. at least a portion of an outer surface of the stick body compressed in a manner such that the density of the compressed portion of the outer surface of the stick body is greater than that of its cross-sectional core, thereby defining a hardened outer surface which has increased strength against impact.

7. The drumstick in claim 6, further comprising a hot stamp foil layer applied to a portion of the drumstick body so that when the stick strikes a percussion instrument, blemishing of the instrument is minimized.

8. An improved drumstick, comprising:

a. a drumstick body having a butt end and a tipped end;

b. a hot stamp foil layer applied to the tipped end portion of the drumstick body as a color coating so that when the tipped end portion strikes the percussion instrument, blemishing of the instrument is minimized;

c. at least the butt end of the drumstick having no hot stamp foil layer applied thereto.

9. The drumstick in claim 8, further comprising a compressed portion of the stick body defining an area of increased strength of the drumstick against impact.

10. The drumstick in claim 8, further comprising a hot stamp foil layer applied to a portion of the drumstick body as a color coating so that when the stick strikes a percussion instrument, blemishing of the instrument is minimized.

11. An improved drumstick of the type having a drumstick body having a first striking end and a second handle end; the improved drumstick made from the process of:

a. providing the drumstick;

b. applying a hot stamp foil layer against a portion of the striking end of the drumstick so that the hot stamp foil layer minimizes blemishing of a percussion instrument when the striking end of the drumstick strikes the instrument.

12. The process of claim 11, wherein the drumstick is fabricated from wood or synthetic material.

13. The process of claim 11, further comprising the step of coating the drumstick with a dye stain prior to applying the hot stamp foil layer.

14. The process of claim 11, wherein the dye stain is treated with a lacquer prior to applying the hot stamp foil layer.

15. The process of claim 11, wherein the stained and lacquered drumstick is covered with the hot stamp foil layer.

16. The process of claim 11, wherein a portion of the drumstick covered with the hot stamp foil layer is compressed to increase the strength of the drumstick against impact.

17. The process of claim 11, wherein the drumstick is then coated with a clear protective overcoat to add a grip characteristic.

18. An improved drumstick of the type having a drumstick body including a first tipped end and a second butt end, the improved drumstick made from the process of:

a. providing the drumstick;

b. compressing a portion of the the outer surface of the drumstick body for defining an area of increased strength of the drumstick body against impact against a percussion instrument.

* * * * *